US007537877B2

(12) United States Patent
Yoshiba et al.

(10) Patent No.: US 7,537,877 B2
(45) Date of Patent: May 26, 2009

(54) TONER USED IN ELECTROPHOTOGRAPHY HAVING TONER PARTICLES AND SILICA POWDER

(75) Inventors: Daisuke Yoshiba, Suntou-gun (JP); Katsuhisa Yamazaki, Numazu (JP); Syuhei Moribe, Numazu (JP); Junko Nishiyama, Suntou-gun (JP); Shuichi Hiroko, Susono (JP); Masami Fujimoto, Suntou-gun (JP); Takashige Kasuya, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/947,523

(22) Filed: Nov. 29, 2007

(65) Prior Publication Data

US 2008/0124643 A1 May 29, 2008

Related U.S. Application Data

(63) Continuation of application No. PCT/JP2007/061678, filed on Jun. 4, 2007.

(30) Foreign Application Priority Data

Jun. 8, 2006 (JP) ..... 2006-159343

(51) Int. Cl.
*G03G 9/08* (2006.01)

(52) U.S. Cl. ..... 430/108.6; 430/108.7

(58) Field of Classification Search ..... 430/108.7, 430/108.6

See application file for complete search history.

(56) References Cited

U.S. PATENT DOCUMENTS

| | | | | |
|---|---|---|---|---|
| 5,342,876 | A * | 8/1994 | Abe et al. | 430/108.7 |
| 5,422,214 | A | 6/1995 | Akiyama et al. | 430/106.6 |
| 6,190,814 | B1 * | 2/2001 | Law et al. | 430/108.7 |
| 6,555,282 | B2 | 4/2003 | Okuno et al. | 430/108.6 |
| 2003/0152506 | A1 | 8/2003 | Shibasaki et al. | 423/335 |

FOREIGN PATENT DOCUMENTS

| | | | |
|---|---|---|---|
| JP | 03-170319 | | 7/1991 |
| JP | 05-142849 | | 6/1993 |
| JP | 05-224456 | | 9/1993 |
| JP | 06-19190 | | 1/1994 |
| JP | 08-220839 | | 8/1996 |
| JP | 2002-3213 | | 1/2002 |
| JP | 2002-108001 | | 4/2002 |
| JP | 2002160907 | A * | 6/2002 |
| JP | 2002-287410 | | 10/2002 |
| JP | 2003-322998 | | 11/2003 |
| JP | 2004-334069 | | 11/2004 |
| JP | 2004-359476 | | 12/2004 |

OTHER PUBLICATIONS

English language transiation of JP 2002-160907 (Jun. 2002).*
Diamond, Arthur S & David Weiss (eds.) Handbook of Imaging Materials, 2nd ed.. New York: Marcel-Dekker, Inc. (Nov. 2001) pp. 145-164.*

* cited by examiner

*Primary Examiner*—Christopher RoDee
(74) *Attorney, Agent, or Firm*—Fitzpatrick, Cella, Harper & Scinto

(57) ABSTRACT

A toner is provided which can stably provide a favorable density stability, line reproducibility and dot reproducibility even in high-speed copying machines, printers and the like which form high resolution latent images over a long period regardless of environmental conditions, and can provide the image quality adaptable to embedded pattern printing, QR code printing and the like. The present invention is characterized in that the toner which includes toner particles including at least a binder resin and a colorant, and a fine silica powder, has a volume median diameter (D50) of not less than 0.70 μm and not more than 3.00 μm, and a total pore volume of not more than 0.200 $cm^3/g$, measured in the range of the pore diameter from not less than 1.7 nm and not more than 300.0 nm.

6 Claims, No Drawings

TONER USED IN ELECTROPHOTOGRAPHY HAVING TONER PARTICLES AND SILICA POWDER

This application is a continuation of International Application No. PCT/JP2007/061678 filed on Jun. 4, 2007, which claims the benefit of Japanese Patent Application No. 2006-159343 filed on Jun. 8, 2006.

BACKGROUND OF THE INVENTION

1. Field of the Invention

The present invention relates to a toner used in electrophotography, image forming methods for visualizing electrostatic charge images, toner jet methods and the like.

2. Description of the Related Art

As image forming methods, many methods such as electrophotography, electrostatic recording, magnetic recording and toner jetting are conventionally known. For example, the electrophotographic method generally involves forming electric latent images on a photosensitive member by any of various units, then developing the latent images with a toner, transferring the toner images to a transfer material such as paper as needed, and thereafter, fixing the toner images on the transfer material by heat, pressure or the like to obtain copies. The remainder of the toner which is not transferred and left on the photosensitive member is cleaned by any of various methods to repeat the above-mentioned process.

In recent years, the security function of copying machines and printers has become important along with the higher resolution and higher performance thereof. For example, prevention of forgery and illegal copying of classified documents, certificates and the like is required and measures against illegal copy by embedded pattern printing and the like are taken.

The embedded pattern printing is a technique in which when documents are printed by a copying machine or printer, an "embedded pattern" concealing character strings is simultaneously printed. In the "embedded pattern", character strings such as "copying prohibited" are previously embedded so as to be hardly viewed and the embedded pattern has a mechanism in which the character strings stand out on copying by a copying machine. Since the embedded pattern printing utilizes a limit of the reproducible capability of dots in copying by a copying machine, a toner is demanded which is excellent in the density stability (density range), dot reproducibility, and line reproducibility, especially line width reproducibility and tailing occurring in line rear ends.

Further, there are more opportunities to use copying machines and printers also in the fields of information recording due to a present sharp increase in information amount. Typical media for information recording include barcode. However, along with the expanded utilizing fields of the barcode, needs to record more information in smaller spaces increase and the so-called QR code (matrix type two-dimensional code), whereby code information is expressed two-dimensionally, is often used. Since even if the QR code is copied several times by a copying machine, an accurate reading precision is required, a toner excellent in the dot reproducibility and the density stability (density range) is demanded.

As described above, for obtaining the image quality adaptable to embedded pattern printing and QR code printing, image forming methods capable of providing higher resolution, higher speed and longer durability are strongly desired in recent years, and therefore, the toner and others are demanded to be further improved.

For example, with respect to the higher resolution, attempts as measures of the copying machine and printer body sides are made in which the high resolution of latent images is improved by reducing the laser spot diameter and raising the charging uniformity of a photosensitive member. On the other hand, as measures of the toner side, attempts are made in which the reproducibility of latent images is improved, for example, by reducing the particle diameter of a toner for faithfully reproducing latent images having a high resolution. However, also in the case of a toner having a reduced particle diameter, since the toner particles move onto latent images in the state of the aggregating, the merit of reducing the particle diameter of the toner cannot be made the best use of and the improvement in the latent image reproducibility is difficult.

Therefore, for obtaining an image quality of a higher resolution, less cohesion between toner particles is also required.

In high speed development systems, since there is a fear of decrease in the image quality, toner performance adaptable to higher speed is demanded.

Efforts to solve the problems described above by measures from the toner side have been made, but the measures are not sufficient for achieving the high-speed and high resolution image formation demanded in recent years, and leave a room for improvement.

For example, addition of various external additives to toner particles for the purpose of improving the chargeability of the toner and imparting a spacer function is proposed. For example, Japanese Patent Application Laid-Open No. H05-142849, Japanese Patent Application Laid-Open No. H05-224456 and Japanese Patent Application Laid-Open No. 2002-287410 propose that addition of a hydrophobic silica and a spherical silica to toner particles raises the image stability. However, since the particle diameter and addition amount of the spherical silica as well as its interrelation with the toner particles are not fully optimized, embedding and release of the spherical silica easily occur in high speed development system; the toners are not sufficient for achieving the high-speed and high resolution image formation and leave a room for improvement. Further, since the chargeability of the toners is not sufficient, the decrease in the image density and the fogging easily occur during a long duration.

Japanese Patent Application Laid-Open No. 2002-003213 proposes that addition of an amorphous fine silica powder to toner particles improves the chargeability of the toner and raises the image stability. Japanese Patent Application Laid-Open No. 2002-108001 proposes the addition of a fine silica powder manufactured by the so-called sol-gel method to toner particles. Although these methods can surely provide images excellent in the density and the fogging, since pores on the surface of the fine silica powder are not controlled, properties of the surface of the fine silica powder are liable to be nonuniform. The toners adsorb moisture in the air under a high-humidity environment and the charging amount of the toners sometimes decreases. Further, in the case of using the toners for high-speed development systems, since there is a case where the fine silica powder does not sufficiently function as a spacer, the toners have room for improvement in adaptability to the higher speed and higher resolution. Japanese Patent Application Laid-Open No. 2004-334069 and Japanese Patent Application Laid-Open No. H06-019190 propose that addition of titanium oxide and aluminum oxide having been subjected to hydrophobization to toner particles raises the chargeability of the toners. Japanese Patent Application Laid-Open No. 2003-322998 proposes that addition of a fine inorganic powder whose particle diameter is prescribed to toner particles raises the image stability. However, although these also have effects on the improvement in the chargeability of the toner and the stabilization of the image density, since the relation of the fine inorganic powder as additive particles with the toner particles is not optimized, the toners are not sufficient in view of the higher image quality.

SUMMARY OF THE INVENTION

Accordingly, it is an object of the present invention to provide a toner whereby the above-mentioned problems are solved. Specifically, it is an object of the present invention to provide a toner capable of stably providing a good density stability, line reproducibility and dot reproducibility in high-speed copying machines, printers and the like over a long period regardless of environments and providing an image quality adaptable to embedded pattern printing, QR code printing and the like.

The above-mentioned object is accomplished by a constitution of the present invention described below.

Specifically, the present invention relates to a toner which has toner particles including at least a binder resin and a colorant, and a fine silica powder, wherein the fine silica powder has a volume median diameter (D50) of not less than 0.70 μm and not more than 3.00 μm and has a total pore volume, measured in the range of the pore diameter from not less than 1.7 nm to not more than 300.0 nm, of not more than 0.200 $cm^3/g$.

The fine silica powder has preferably an average pore diameter of not more than 50.0 nm.

The toner preferably has a hydrophobic fine inorganic powder which has a BET specific surface area of not less than 50 $m^2/g$ and not more than 300 $m^2/g$.

In the moisture adsorption-desorption isotherm at 30° C. of the fine silica powder, the adsorbed moisture amount in the adsorption process at a relative humidity of 80% RH is preferably in the range from 0.01 to 1.00 mass %.

The fine silica powder is preferably prepared by the gas phase method.

According to the present invention, a toner capable of stably providing an excellent density stability, line reproducibility and dot reproducibility in high-speed copying machines, printers and the like which form high resolution latent images, over a long period regardless of environments and providing an image quality adaptable to embedded pattern printing, QR code printing and the like, can be provided.

DESCRIPTION OF THE EMBODIMENTS

As a result of studies on constituting materials used for a toner, the present inventors have found that, in a toner which includes toner particles including at least a binder resin and a colorant, and a fine silica powder, by controlling the particle diameter and the pores of the fine silica powder, the toner capable of stably providing an excellent density stability, line reproducibility and dot reproducibility in high-speed copying machines, printers and the like which form high resolution latent images, over a long period regardless of environments and providing an image quality adaptable to embedded pattern printing, QR code printing and the like, can be obtained.

Specifically, the present invention is characterized in that, in a toner which includes toner particles including at least a binder resin and a colorant, and a fine silica powder, the fine silica powder has a volume median diameter (D50) of not less than 0.70 μm and not more than 3.00 μm and has a total pore volume, measured in the range of the pore diameter from not less than 1.7 nm to not more than 300.0 nm, of not more than 0.200 $cm^3/g$.

Many proposals are conventionally made in which a fine inorganic powder is added to toner particles for the purpose of raising the chargeability of the toner particles and imparting the spacer function thereto. For effectively imparting the functions, the fine inorganic powder is required to have a high charging capability, a sharp particle diameter distribution and a uniform shape; among fine inorganic powders, especially fine silica powders meet these requirement performances, and are preferably used.

However, since the fine surface structure and particle diameter of the fine silica powders are not sufficiently controlled, further improvements are needed to obtain a high resolution image quality of embedded pattern printing, QR code printing and the like.

Since fine silica powders used for the toner application are commonly amorphous, and have many pores of the submicrometer order (several nanometers to several hundred nanometers) on their surface, the electrostatic charge is likely to become nonuniform. Particularly under a high-humidity environment, since water molecules in the air intrude the pores, the charging capability of a toner decreases during duration. Consequently, since the chargeability of the toner becomes further nonuniform, the toner easily aggregates, sometimes worsening the line reproducibility and dot reproducibility. Further, a decrease in the charging capability sometimes decreases the image density in the latter half of duration.

Further, in high-speed development systems, since a toner undergoes a large shear in a developing machine, the toner easily generates the toner deterioration due to the embedding and the like of external additives in the developing machine.

Under such an environment, since the function as a spacer of a fine silica powder decreases, the toner strongly undergoes influences of the nonuniforming of charging and the decrease in charging capability, more easily aggregating.

For reducing such a toner deterioration, although an optimum amount of a fine silica powder having a larger particle diameter must be added, addition of the fine silica powder of the larger particle diameter having a fine structure on its surface is unpreferable because an influence of the nonuniforming of charging emerges.

That is, only the addition of a fine silica powder simply as a spacer as conventionally is not sufficient in high-speed development systems, and the control of the surface properties by controlling the surface fine structure and the optimization of the particle diameter become important as in the present invention.

Then, as a result of extensive studies on pore states of the surface of a fine silica powder, the present inventors have found that the addition of a fine silica powder having a specific pore state to toner particles can stably provide an excellent density stability, line reproducibility and dot reproducibility even in copying machines, printers and the like which form high resolution latent images, over a long period regardless of environments.

Specifically, the present invention is characterized by using a fine silica powder having a total pore volume, measured in the range of the pore diameter from not less than 1.7 nm to not more than 300.0 nm, of not more than 0.200 $cm^3/g$. The total pore volume is preferably not more than 0.070 $cm^3/g$, more preferably not more than 0.025 $cm^3/g$.

That the total pore volume measured in the range of the pore diameter from not less than 1.7 nm to not more than 300.0 nm is not more than 0.200 $cm^3/g$ represents that the number of pores in the surface of the fine silica powder is small and/or that the volume of every pore is small. By making the surface structure have no pores and uniform in such a way, since the chargeability of the fine silica powder becomes uniform and the fine silica powder is largely improved in moisture resistance, the chargeability can stably be maintained over a long period regardless of environments. Therefore, since the chargeability of a toner becomes uniform and stable, the toner can faithfully reproduce high resolution latent images without aggregation of the toner even in high-speed copying machines, printers and the like. Consequently, the toner can stably provide an excellent density stability, line reproducibility and dot reproducibility over a long period regardless of environments.

That the total pore volume is larger than 0.200 $cm^3/g$ represents that many pores are present in the surface of a fine silica powder and/or that the volume of every pore is large. In the case of such a fine silica powder, since the surface fine structure is nonuniform, the chargeability becomes nonuniform; and further, since water molecules in the air intrude pores, the charging capability decreases during duration. As a result, since the chargeability of the toner becomes nonuniform in high-speed development systems, the cohesiveness worsens and the line reproducibility and dot reproducibility easily deteriorate. Further, since the charging capability decreases, the image density easily decreases and the fogging easily worsens in the latter half of duration.

In the present invention, the total pore volume is measured in the range of the pore diameter from not less than 1.7 nm to not more than 300.0 nm where the surface pore state of a fine silica powder can be well reproducibly measured and the pore state can accurately be measured in a long range.

The present inventors have also found that use of a fine silica powder having a total pore volume, measured in the range of the pore diameter from not less than 1.7 nm to not more than 300.0 nm, of not more than 0.200 $cm^3/g$ allows addition of the fine silica powder having a larger particle diameter to toner particles. Specifically, the fine silica powder of the present invention is characterized by having a volume median diameter (D50) of not less than 0.70 μm and not more than 3.00 μm (preferably not less than 0.70 μm and not more than 1.50 μm). By controlling the particle diameter of the fine silica powder in the above range, the toner does not generate the toner deterioration due to embedding and the like of the fine silica powder even in an environment where the toner undergoes a large shear in developing machines like higher-speed development systems, and can stably provide images having an excellent density stability, line reproducibility and dot reproducibility over a long period regardless of environments.

The fine silica powder having a median diameter (D50) of less than 0.70 μm is easily embedded in the toner particles, and worsens the toner cohesiveness in high-speed development systems and easily decreases the line reproducibility and dot reproducibility. By contrast, the fine silica powder having a median diameter (D50) of more than 3.00 μm is easily liberated from the toner particles, and decreases the image density in the latter half of duration.

In the present invention, to control the volume median diameter (D50) of a fine silica powder in not less than 0.70 μm and not more than 3.00 μm and control the total pore volume, measured in the range of the pore diameter from not less than 1.7 nm to not more than 300.0 nm, in not more than 0.200 $cm^3/g$, the synthetic concentration and temperature and the cooling rate are achievably controlled in a preparation method of a fine silica powder. As long as the particle diameter and pores of a fine silica powder are controlled in the above range, the particle shape is not especially limited.

The pore volume in the present invention is measured by the gas adsorption method in which nitrogen gas is adsorbed on a sample surface, using a Porosimetry Analyzer Tristar 3000 (Shimadzu Corp.). The outline of the measurement is described in an operating manual issued by Shimadzu Corp., which is as follows. Before the measurement of the pore distribution, 1 to 2 g of a sample is charged in a sample tube and vacuumed at 100° C. for 24 h. After the completion of the vacuuming, the sample is precisely weighed to obtain a sample. The total pore volume in the range of the pore diameter from not less than 1.7 nm to not more than 300.0 nm of the obtained sample is determined by the BJH desorption method using the Porosimetry Analyzer. The pore distribution is preferably evaluated based on the total pore volume nearest to the relevant measurement data information.

The particle diameter distribution measurement in the present invention is made using a laser diffraction/scattering type particle diameter distribution analyzer LA-920 (HORIBA Ltd.). The measuring method involves adding, for example, approximately 30 mg of a sample to 100 ml of an ion exchange water to become a dispersion medium, and subjecting the dispersed liquid to a treatment by an ultrasound disperser for 1 minute to make a dispersed liquid. The dispersed liquid is dropwise charged in a measuring cell such that the sample concentration has a transmissivity of approximately 80%. The relative refractive indexes of the measurement sample and water are set depending on the sample type and the particle diameter distribution based on volume is measured using the above-mentioned analyzer to determine a median diameter (D50).

The present invention is characterized in that by using a fine silica powder described above whose pore distribution and particle diameter are controlled, the toner does not aggregate and easily loosen in development even in an environment where the toner undergoes a large shear in developing machines like high-speed development systems, that is, in the state of the toner being consolidated.

The evaluation of the cohesiveness of a toner in the consolidation state uses a ShearScan TS-12 (Sci-Tec Co.). The ShearScan measures on a principle by the Mohr-Coulomb model described in CHARACTERIZING POWDER FLOWABILITY (published in 24 Jan. 2002) written by Prof. Virendra M. Puri.

Specifically, the measurement is conducted in room temperature environment (23° C., 60% RH) using a linear shearing cell (cylindrical, 80 mm in diameter, 140 $cm^3$ in volume) which can impart a shearing force linearly in the sectional direction. A toner is charged in this cell, and loaded with a vertical load so as to become 2.5 kPa to fabricate a consolidated powder layer so as to take a closest packing state at this vertical load (the measurement by ShearScan is preferable in the present invention in that this consolidation state can be fabricated with no personal difference while the pressure is automatically detected). Similarly, consolidated powder layers with the vertical load being 5.0 kPa and 10.0 kPa are formed. A test is conducted in which the sample formed at the each vertical load is gradually loaded with a shearing force while continuously loaded with the vertical load applied when the consolidated powder layer have been formed, and variations of shear stress at this time are measured to determine a stationary point. The consolidated powder layer is determined to have reached a stationary point when the variations in the shear stress and the displacement in the vertical direction of a loading unit to apply a vertical load become small and both the variations and the displacement come to take steady values in the test. Then, the vertical load is gradually deloaded from the consolidated powder layer which has reached a stationary point; a failure envelope at each load (a plot of vertical load stress vs. shear stress) is fabricated; and a Y-intercept and a slant are determined. In the analysis by the Mohr-Coulomb model, the unconfined yield stress and the maximum consolidation stress are represented by the following expressions; and the Y-intercept denotes a 'cohesive force' and the slant denotes an 'internal friction angle'.

$$\text{Unconfined yield stress}=2c(1+\sin\phi)/\cos\phi$$

$$\text{Maximum consolidation stress}=((A-(A^2\sin^2\phi-\tau_{ssp}^2\cos^2\phi)^{0.5})/\cos^2\phi)\times(1+\sin\phi)-(c/\tan\phi)$$

($A=\sigma_{ssp}+(c/\tan\phi)$, c=a cohesive force, $\phi$= an internal friction angle, $\tau_{ssp}=c+\sigma_{ssp}\times\tan\phi$, and $\sigma_{ssp}$=a vertical load at a stationary point)

Unconfined yield stresses and maximum consolidation stresses calculated at each vertical load are plotted (Flow Function Plot) and a straight line is drawn based on the plot. The unconfined yield stresses at 0.1 kPa and 20.0 kPa in maximum consolidation stress are determined from this straight line.

Use of the relation of the maximum consolidation stress (X) and the unconfined yield stress (U) allows discussion of the loosenability of a powder layer consolidated at any load, that is, powder characteristics (cohesive force between toner particles) of a closely packed toner layer. The unconfined yield stress (U) relates to the loosenability by stirring in a toner container and to a situation when a toner passes through a control section and is coated on a toner carrier while undergoing a shear by a control member. Further, the maximum consolidation stress (X) in the present invention denotes a stress loaded on a toner which is closely packed by a shear the toner undergoes in a developing machine.

Accordingly, the unconfined yield stress at 0.1 kPa in maximum consolidation stress allows discussion of powder characteristics in a state of a relatively small shear on a toner; and the unconfined yield stress at 20.0 kPa in maximum consolidation stress allows discussion of powder characteristics in a state of a relatively large shear on the toner. By the evaluation of transition of the unconfined yield stresses between the maximum consolidation stresses, powder characteristics of a toner layer under a consolidated state are expressed.

The toner of the present invention preferably has an unconfined yield stress of not more than 1 kPa at a maximum consolidation stress of 0.1 kPa of the toner, and an unconfined yield stress of not less than 2.0 kPa and not more than 6.0 kPa at a maximum consolidation stress of 20.0 kPa of the toner. By controlling a toner in the above range, the toner does not aggregate even in either state of a low-pressure consolidation and a high-pressure consolidation, and easily loosens in development, which is preferable.

As long as a fine silica powder used in the present invention has the above characteristics, any one can be used, but one having characteristics described below is preferable.

A fine silica powder in the present invention preferably has an average pore diameter of not more than 50.0 nm. The case of the average pore diameter of more than 50.0 nm indicates that pores in the surface of the fine silica powder are large. In the case of such a fine silica powder, the adsorbed moisture amount becomes large in a high-humidity environment and the charging capability easily decreases, which is unpreferable.

The average pore diameter of a fine silica powder in the present invention is determined by a measuring method similar to that for the pore volume described before.

Further, the toner according to the present invention preferably includes a hydrophobic fine inorganic powder having a BET specific surface area of not less than 50 $m^2/g$ and not more than 300 $m^2/g$.

By using together a hydrophobic fine inorganic powder which has a high fluidity-imparting capability to the surface of a toner and a large BET specific surface area, a fine silica powder can be homogeneously dispersed in the toner.

With the BET specific surface area of a hydrophobic fine inorganic powder of less than 50, the fine silica powder is not sufficiently dispersed, which is unpreferable. With the BET specific surface area of a hydrophobic fine inorganic powder of more than 300, the toner charges up, unpreferably causing negative effects such as decrease in density.

Hydrophobic fine inorganic powders include, for example, silicon dioxide (silica), titanium dioxide (titania), aluminum oxide (alumina), zinc oxide, magnesium oxide, cerium oxide, iron oxide, copper oxide and tin oxide. Among these, especially a dry silica called a dry-method or fumed silica produced by vapor phase oxidation of a silicon halide is preferably used.

Hydrophobization can be performed by using a treating agent, such as silicone vanishes, variously modified silicone vanishes, silicone oils, variously modified silicone oils, silane compounds, silane coupling agents, other organic silicon compounds and organic titanium compounds, singly or in a combination of two or more.

The measuring method of the BET specific surface area involves, according to the BET specific surface area method, using a specific surface area analyzer Gemini 2375 (Shimadzu Corp.), making nitrogen gas adsorbed on the surface of a sample, and using the multipoint method of BET specific surface area to calculate a specific surface area.

A fine silica powder in the present invention has, in its moisture adsorption-desorption isotherm at 30° C., an adsorbed moisture amount, in the adsorption process at a relative humidity of 80% RH, preferably of not less than 0.01 mass % and not more than 1.00 mass %, more preferably not less than 0.01 mass % and not more than 0.50 mass %, especially preferably not less than 0.10 mass % and not more than 0.20 mass %. The case where the adsorbed moisture amount at a relative humidity of 80% RH is larger than 1.00 mass % indicates that the amount of adsorbed moisture is much. Since such a fine silica powder decreases the chargeability of a toner and worsens the cohesiveness, the developability worsens (decrease in density, increase in fogging). By contrast, the case where the adsorbed moisture amount is lower than 0.01 mass % indicates that the fine silica powder has an excessive hydrophobicity. An excessively strong hydrophobicity collapses the charging balance such as charge-up, and is likely to decrease the density and worsen the fogging.

The adsorbed moisture amount in the present invention is measured using an adsorption equilibrium measuring apparatus (Tokyo Testing Machine Inc., "EAM-02"). This apparatus makes a solid-gas system reach a solid-gas equilibrium under the condition where an objective gas (in the present invention, water) only is present, and measures the solid weight and the vapor pressure at this time.

The actual measurement of the moisture adsorption-desorption isotherm is entirely conducted automatically by a computer from measurement of a dry weight and deaeration of dissolved air in water to measurement of a moisture adsorption-desorption isotherm, which are shown below. The outline of the measurement is described in an operation manual published by Tokyo Testing Machine Inc., and is as follows. Here, in the present invention, water is used as a solvent liquid.

First, approximately 5 g of a sample is charged in a sample container in an adsorption tube, and then, the temperature of a constant-temperature bath and the temperature of the sample portion are set at 30° C. Thereafter, air valves V1 (main valve) and V2 (exhaust valve) are opened; and a vacuum exhaust section is operated to vacuum a vacuum vessel interior to approximately 0.01 mmHg to dry the sample. A mass at the time when the mass of the sample comes not to change is defined as "dry mass".

Since air is dissolved in water as a solvent liquid, deaeration must be performed. First, water is charged in a liquid reservoir; the vacuum exhaust section is operated; the air valve V2 and an air valve V3 (liquid reservoir valve) are alternately opened to remove the dissolved air. The above operation is several times repeated, and the time when air bubbles come not to be found is the finish of the deaeration.

Following the measurement of the dry mass and the deaeration of dissolved air in water, the air valves V1, V2 are closed with the vacuum vessel interior kept under vacuum and the air valve V3 is opened to introduce water vapor from the liquid reservoir, and the air valve is closed. Then, the air valve V1 is opened to introduce the solvent vapor into the vacuum vessel and the pressure is measured by a pressure sensor. If the pressure in the vacuum vessel does not reach a set pressure, the pressure in the vacuum vessel is made the set pressure by repeating the above operation. When equilibrium is reached, the pressure in the vacuum vessel and the weight become constant, and the pressure and temperature and the sample weight at this time are measured as an equilibrium data.

By the operations as described above, an adsorption-desorption isotherm can be measured by shifting the pressure of the water vapor. In an actual measurement, relative vapor pressures for measurement of adsorbing amounts are set in advance. With the set pressures of, for example, 5%, 10%, 30%, 50% 70%, 80%, 90% and 95%, the "adsorption process" in the present invention refers to a process in which an isotherm is drawn by measuring adsorbed moisture amounts in order from 5% upward; and the "desorption process" refers to a process in which, following the adsorption process, adsorbed moisture amounts are measured while the relative vapor pressure is reduced from 95% in the reverse order to the adsorption process.

In this apparatus, the pressure is set as a relative vapor pressure (%RH) and the adsorption-desorption isotherm is represented by the adsorbed amount (%) and the relative vapor pressure (%RH). The calculating expressions of the adsorbed amount and the relative vapor pressure are shown below.

$$M=((Wk\ Wc)/Wc)100$$

$$Pk=(Q/Q0)100$$

(wherein, M denotes an adsorbed amount (%); Pk denotes a relative vapor pressure (%); Wk (mg) denotes a sample mass; Wc (mg) denotes a dry mass of a sample; Q0 (mmHg) denotes a saturated vapor pressure of water determined by the Antoine formula by using a temperature Tk (° C.) at an adsorption-desorption equilibrium; and Q (mmHg) denotes a pressure measured as an equilibrium data.)

A fine silica powder used in the present invention preferably has a specific surface area of not less than 1.0 $m^2/g$ and not more than 20.0 $m^2/g$, more preferably not less than 2.0 $m^2/g$ and not more than 10.0 $m^2/g$.

With the specific surface area of more than 20.0 $m^2/g$, the fine silica powder is embedded in toner particles. That is, since the toner deterioration easily occurs, negative effects such as decrease in the image density in the latter half of duration are generated. With the specific surface area of less than 1.0 $m^2/g$, the toner does not acquire a sufficient fluidity, causing negative effects such as decrease in the density in the latter half of duration.

The measuring method of the BET specific surface area involves, according to the BET specific surface area method, using a specific surface area analyzer Gemini 2375 (Shimadzu Corp.), making nitrogen gas adsorbed on the surface of a sample, and using the multipoint method of BET specific surface area to calculate a specific surface area.

The fine silica powder, which is a feature of the present invention, having an average pore diameter in the range of not less than 5.0 nm and not more than 50.0 nm and a total pore volume, with the pore diameter of not less than 1.7 nm and not more than 300.0 nm, of not more than 0.200 $cm^3/g$, is manufactured preferably by the gas phase method.

The preparation methods of a fine silica powder are classified into two types: the gas phase method in which the fine silica powder is produced by reacting a silicon compound, such as metal silicon, a silicon halide or a silane compound, in a gas phase; and the wet method in which the fine silica powder is obtained by removing a solvent from a silica sol suspension obtained by subjecting a silane compound such as an alkoxysilane to hydrolysis and condensation reaction in a water/organic solvent mixture, drying and granulating the solvent-removed suspension.

The present inventors have found that by optimizing the reaction condition of the gas phase method, the surface pore state of the fine silica powder can easily be controlled in the above range.

Specifically, in the gas phase reaction, the temperature in the reaction system can be set above the melting point of the silica to form the fine silica powder having a small number of pores, since it is manufactured while molten. Further, by controlling the cooling rate from the melting state, the pore state can easily be controlled. Rapid cooling without control of the cooling rate easily causes pores, which is unpreferable.

In the present invention, vapor-phase oxidation among vapor-phase methods is especially preferable whereby a fine silica powder is obtained by directly oxidizing a metal silicon powder raw material in a chemical flame composed of oxygen and hydrogen. The vapor-phase oxidation can make the temperature inside the reaction system instantaneously above the melting point of the silica, and is a preferable method to control the surface pore structure and the particle diameter.

On the other hand, in the wet method, since a fine silica powder is produced from a silica sol suspension obtained by hydrolysis and condensation reaction of a silane compound, the fine silica powder has a structure having an infinite number of pores in its surface. Further, since the wet method has a lower reaction rate than the vapor-phase method and has a difficulty in controlling the pore distribution, the wet method is not a preferable preparation method of a fine silica powder with controlled porosity, which is a feature of the present invention.

The content of the fine silica powder used in the present invention is preferably not less than 0.05 parts by mass and not more than 2.00 parts by mass based on 100 parts by mass of toner particles. With the content of a fine silica powder of more than 2.00 parts by mass, a balance in chargeability of a toner collapses, easily causing problems such as the density decrease and fogging. If the content of the fine silica powder is less than 0.05 parts by mass, the toner has an insufficient amount of the power, which does not provide an effect of raising the chargeability by the addition of the fine silica powder.

In the present invention, toner particles preferably have a weight-average particle diameter (D4) of not less than 4.0 μm and not more than 9.0 μm. Control of the particle diameter of the toner particles in the above range allows a more faithful reproduction of electrostatic latent images having a higher resolution, which is preferable in view of adaptation to a security image quality. Further, in a system where a fine silica powder having a volume median diameter (D50) of not less than 0.70 μm and not more than 3.00 μm is loaded, the fine silica powder most effectively functions as a spacer, and hardly aggregates even in a consolidated state.

When toner particles has a weight-average particle diameter (D4) of less than 4.0 μm, since a balance in particle diameter between the toner and a fine silica powder collapses, the toner is not provided with a sufficient fluidity, causing negative effects such as decrease in the density in the latter half of duration. When toner particles has a weight-average particle diameter (D4) of more than 9.0 μm, reproducibility to electrostatic latent images having a higher resolution remarkably decreases, which is not preferable in view of adaptability to a security image quality.

The toner of the present invention preferably has an acid value of not less than 5.0 mgKOH/g and not more than 50.0 mgKOH/g, more preferably not less than 10.0 mgKOH/g and not more than 40.0 mgKOH/g.

By controlling the acid value of the toner in this range, the affinity between a carboxyl group on the toner particle surface and a fine silica powder improves, allowing the secure presence of the fine silica powder on the toner particle surface. As a result, the liberation rate of the fine silica powder from the toner particles is allowed to be controlled in an optimum range, providing a stable chargeability and improving the durable developability.

When the toner has an acid value of less than 5.0 mgKOH/g, the affinity between the toner particle surface and the fine silica powder decreases, easily causing the isolation of the fine silica powder from the toner particle surface. As a result, the fine silica powder cannot provide the effect as a spacer. When the toner has an acid value exceeding 50.0 mgKOH/g, a balance in chargeability of the toner particles collapses, providing a tendency of decreasing the image density and increasing the fogging. Further, increase in the adsorbed moisture amount damages the environmental stability.

The toner particles of the present invention preferably have a negative chargeability. Addition of a fine silica powder, which has a highly negatively charging capability, to negatively chargeable toner particles makes the charging of the toner surface uniform, resulting in providing an effect of relaxing the electrostatic cohesion between the toners generated by the charging nonuniformity. As a result, since aggregated lumps of the toner easily loosen when an electric field is applied, latent images can faithfully be reproduced without overflowing the latent images even in the latent images having a high resolution formed by diameter-reduced laser spots, which is preferable in view of adaptability to a security image quality.

The type of binder resin used in the present invention includes styrenic resins, styrenic copolymerized resins, polyester resins, polyol resins, polyvinyl chloride resins, phenol resins, natural resin-modified phenol resins, natural resin-modified maleic acid resins, acryl resins, methacryl resins, polyvinyl acetate resins, silicone resins, polyurethane resins, polyamide resins, furan resins, epoxy resins, xylene resins, polyvinyl butyrals, terpene resins, coumarone-indene resins and petroleum resins. Among these preferably used are styrenic copolymerized resins, polyester resins and hybrid resins obtained by mixing or partially reacting a polyester resin and a vinyl resin.

If a binder resin including a polyester resin having a carboxyl group on its terminal is used, a fine silica powder having a controlled surface fine structure, which is a feature of the present invention, has a higher and rapidly-rising chargeability and provides the image density stable over a long period, so it is preferably used.

Polyester monomers constituting the polyester resins or a polyester unit of the above-mentioned hybrid resins used for the binder resin according to the present invention include the following compounds.

Alcohol components include ethylene glycols, propylene glycols, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the formula (I-1) below and diols represented by the formula (I-2) below.

(Formula I)

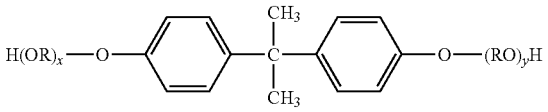

(I-1)

(wherein, R denotes an ethylene group or a propylene group; and x and y are each an integer of one or more, and an average of x + y is 2 to 10)

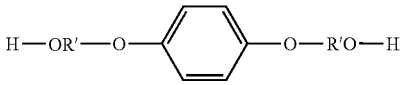

(I-2)

(wherein, R′ denotes $-CH_2CH_2-$, $-CH_2-CH(CH_3)-$ or $-CH_2-C(CH_3)_2-$)

Acid components include benzenedicarboxylic acids or their anhydrides such as phthalic acid, terephthalic acid, isophthalic acid and phthalic anhydride; alkyldicarboxylic acids or their anhydrides such as succinic acid, adipic acid, sebacic acid and azelaic acid; succinic acid or its anhydride substituted with an alkyl group or alkenyl group having 6 to 18 carbon atoms; and unsaturated dicarboxylic acids or their anhydrides such as fumaric acid, maleic acid, citraconic acid and itaconic acid.

A polyester resin or a polyester unit according to the present invention is preferably a polyester resin including a crosslinking structure by a tri- or more valent carboxylic acid or its anhydride and/or a tri- or more hydric alcohol. Tri- or more valent carboxylic acids or their anhydrides include, for example, 1,2,4-benzenetricarboxylic acid, 1,2,4-cyclohexanetricarboxylic acid, 1,2,4-naphthalenetricarboxylic acid, pyromellitic acid, and their acid anhydrides or their low alkyl esters; and tri- or more hydric alcohols include, for example, 1,2,3-propanetriol, trimethylolpropane, hexanetriol and pentaerythritol. In the binder resin of the present invention, aromatic alcohols which is stable against environmental variations are especially preferable, and include, for example, 1,2,4-benzenetricarboxylic acid and its anhydride.

Vinyl monomers constituting a vinyl resin or a vinyl polymer unit of a hybrid resin used for a binder resin according to the present invention include the following compounds:

Styrene and its derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylenically unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinyl pyrrole, N-vinyl carbazol, N-vinyl indole and N-vinyl pyrrolidone; vinyl naphthalenes; and acrylic acid or methacrylic acid derivatives such as acrylonitrile, methacrylonitrile and acrylamide.

They further include unsaturated dibasic acids such as maleic acid, citraconic acid, itaconic acid, alkenylsuccinic acid, fumaric acid and mesaconic acid; unsaturated dibasic anhydride such as maleic anhydride, citraconic anhydride, itaconic anhydride and alkenylsuccinic anhydride; half esters of unsaturated dibasic acids such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester and methyl mesaconate half ester; unsaturated dibasic acid esters such as dimethyl maleate and dimethyl fumarate; α, β-unsaturated acids such as acrylic acid, methacrylic acid, crotonic acid and cinnamic acid; α, β-unsaturated acid anhydrides such as crotonic anhydride and cinnamic anhydride; anhydrides of the α, β-unsaturated acids and low aliphatic acids; and alkenylmalonic acid, alkenylglutaric acid, alkenyladipic acid, their anhydrides, and carboxyl-containing monomers such as their monoesters.

They further include acrylic or methacrylic esters such as 2-hydroxyethyl acrylate, 2-hydroxyethyl methacrylate and 2-hydroxypropyl methacrylate; monomers having a hydroxyl group such as 4-(1-hydroxy-1-methylbutyl)styrene and 4-(1-hydroxy-1-methylhexyl)styrene.

In the toner of the present invention, vinyl resins or vinyl polymer units used for a binder resin may have a crosslinking structure which is crosslinked by a crosslinking agent having at least two vinyl groups. The crosslinking agent used in this case includes, for example; as aromatic divinyl compounds, divinyl benzene and divinylnaphthalene; as diacrylate compounds which are bonded with an alkyl chain, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate and compounds obtained by substituting the acrylate of the above compounds with a methacrylate; as diacrylate compounds which are bonded with an alkyl chain having an ether bond, diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting the acrylate of the above compounds with a methacrylate; as diacrylate compounds which are bonded with a chain having an aromatic group and an ether bond, polyoxyethylene(2)-2,2-bis(4-hydroxyphenyl)propanediacrylate, polyoxyethylene(4)-2,2-bis(4-hydroxyphenyl)propanediacrylate and compounds obtained by substituting the acrylate of the above compounds with a methacrylate; and polyester type diacrylate compounds, for example, "MANDA" made by Nippon Kayaku Co., Ltd.

Polyfunctional crosslinking agents include pentaerythritol triacrylate, trimethylolethane triacrylate, trimethylolpropane triacrylate, tetramethylolmethane tetraacrylate, oligoester acrylate and compounds obtained by substituting the acrylate of the above compounds with a methacrylate; and triallyl cyanurate and triallyl trimellitate.

These crosslinking agents can be used in not less than 0.01 parts by mass and not more than 10 parts by mass, more preferably not less than 0.03 parts by mass and not more than 5 parts by mass, based on 100 parts by mass of the other monomer components.

Among these crosslinking agents, those suitably used for a binder resin in view of fixability and off-set resistance include aromatic divinyl compounds (especially divinylbenzene), and diacrylate compounds which are bonded with a chain having an aromatic group and an ether bond.

Polymerization initiators used for polymerization of the above-mentioned vinyl resins or vinyl polymer units include, for example, 2,2'-azobisisobutylonitrile, 2,2'-azobis(4-methoxy-2,4-dimethylvaleronitrile), 2,2'-azobis(2,4-dimethylvaleronitrile), 2,2'-azobis(2-methylbutylonitrile), dimethyl-2,2'-azobisisobutylate, 1,1'-azobis(1-cyclohexanecarbonitrile), 2-(carbamoylazo)isobutylonitrile, 2,2'-azobis(2,4,4-trimethylpentane), 2-phenylazo-2,4-dimethyl-4-methoxyvaleronitrile, 2,2'-azobis(2-methylpropane), ketone peroxides such as methyl ethyl ketone peroxide, acetylacetone peroxide and cyclohexanone peroxide, 2,2'-bis(tert-butylperoxy)butane, tert-butyl hydroperoxide, cumene hydroperoxide, 1,1,3,3-tetramethylbutyl hydroperoxide, di-tert-butyl peroxide, tert-butyl cumyl peroxide, dicumyl peroxide, α, α'-bis(tert-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropylperoxydicarbonate, di-2-ethylhexylperoxydicarbonate, di-n-propylperoxydicarbonate, di-2-ethoxyethylperoxycarbonate, dimethoxyisopropylperoxydicarbonate, di(3-methyl-3-methoxybutyl)peroxycarbonate, acetyl cyclohexylsulfonyl peroxide, tert-butylperoxyacetate, tert-butylperoxyisobutylate, tert-butylperoxyneodecanoate, tert-butylperoxy-2-ethylhexanoate, tert-butylperoxylaurate, tert-butylperoxybenzoate, tert-butylperoxyisopropyl carbonate, di-tert-butylperoxyisophthalate, tert-butylperoxyallyl carbonate, tert-amylperoxy-2-ethylhexanoate, di-tert-butylperoxyhexahydroterephthalate and di-tert-butylperoxyazelate.

In the present invention, when the above-mentioned hybrid resins are used as a binder resin, the vinyl resin and/or the polyester resin component preferably includes a monomer component reactive with both the resin components. Among monomers constituting the polyester resin components, monomers reactive with the vinyl resins include, for example, unsaturated dicarboxylic acids such as phthalic acid, maleic acid, citraconic acid and itaconic acid, and their anhydrides. Among monomers constituting the vinyl resin components, monomers reactive with the polyester resin components include compounds having a carboxyl group or a hydroxyl group, and acrylic acid or methacrylic acid esters.

A method for obtaining a reaction product of a vinyl resin and a polyester resin preferably involves performing the polymerization reaction for one of or both the vinyl resin and the polyester resin described before in the presence of a polymer containing a monomer component reactive with each of the resins.

In the hybrid resin, the mass ratio of a polyester monomer and a vinyl monomer is preferably 50/50 to 90/10, further preferably 60/40 to 85/15. With the mass ratio of the polyester monomer of less than 50%, the chargeability of the toner particles is damaged; and with the mass ratio exceeding 90%, a balance in the chargeability not only collapses but causes an influence on the preservability and the dispersion state of a releasing agent.

The binder resin preferably includes not less than 30 mass % of low molecular-weight components having a molecular weight of not more than 10,000, which is measured by GPC for components soluble in tetrahydrofuran (THF) in view of the low-temperature fixability.

The binder resin preferably has a glass transition temperature of not less than 53° C. and not more than 62° C. in view of the fixability and preservability.

The above-mentioned binder resin may be used singly, but in the present invention, the binder resin may be used as a mixture of two kinds of resins, having different softening points, a high-softening point resin (A) and a low-softening point resin (B) in the proportional range of 90/10 to 10/90. In such a system, the molecular weight distribution of a toner can be relatively easily designed and the toner can be made to have a wide fixing region, which is preferable.

The colorant of the present invention is preferably a magnetic iron oxide. Since use of a magnetic iron oxide of a dielectric as a colorant allows easy loosening of aggregated lumps of a toner on application of an electric field, even latent images having a high resolution formed by diameter-reduced laser spots can faithfully be reproduced without overflowing the latent images, which is preferable in view of adaptability to the security image quality. The magnetic iron oxide is preferably used also in view of the durable stability in high-speed machines.

As a magnetic iron oxide, iron oxides such as magnetite, maghemite, and ferrite are used. A slurry during the manufacture of the magnetic iron oxide of the present invention, for the purpose of improving micro-dispersibility of the magnetic iron oxide into toner particles, is preferably subjected to shear to once loosen the magnetic iron oxide.

In the present invention, the amount of the magnetic iron oxide included in a toner is preferably not less than 20 parts by mass and not more than 200 parts by mass, more preferably not less than 30 parts by mass and not more than 150 parts by mass, based on 100 parts by mass of a binder resin.

In the present invention, a wax may be used, if required, to make the toner releasable. As the wax, hydrocarbon waxes such as low molecular-weight polyethylenes, low molecular-weight polypropylenes, microcrystalline waxes and paraffin waxes are preferably used because of their easy dispersibility in a toner and high releasability, but one or more other waxes can be together used in a small amount as necessary. Examples are as follows:

Oxides of aliphatic hydrocarbon waxes such as oxidized polyethylene waxes or their block copolymers; waxes, including fatty acid esters as a main component, such as carnauba wax, sazol wax and montanic acid ester wax; and waxes, obtained by deacidifying partially or entirely fatty acid esters, such as deacidified carnauba wax. Further examples include saturated linear fatty acids such as palmitic acid, stearic acid and montanic acid; unsaturated fatty acids such as brasidic acid, eleostearic acid and valinalic acid; saturated alcohols such as stearyl alcohol, aralkyl alcohol, behenyl alcohol, carnaubyl alcohol, ceryl alcohol and melissyl alcohol; long chain alkyl alcohols; polyhydric alcohols such as sorbitol; fatty acid amides such as linoleic acid amide, oleic acid amide and lauric acid amide; saturated fatty acid bisamides such as methylenebisstearic acid amide, ethylenebiscapric acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylsebacic acid amide; aromatic bisamides such as m-xylenebisstearic acid amide and N,N'-distearylisophthalic acid amide; fatty acid metal salts (commonly called metal soaps) such as calcium stearate, calcium laurate, zinc stearate and magnesium stearate; waxes obtained by grafting vinyl monomers such as styrene and acrylic acid to aliphatic hydrocarbon waxes; and partially esterified compounds of fatty acids and polyhydric alcohols, such as behenic acid monoglyceride, and methyl ester compounds having a hydroxyl group obtained by hydrogenating vegetable oils.

Releasing agents especially preferably used in the present invention include aliphatic hydrocarbon waxes. Such aliphatic hydrocarbon waxes include, for example, low molecular-weight alkylene polymers obtained by radical polymerization of an alkylene under high pressure or by polymerization under low pressure using the Ziegler catalyst; alkylene polymers obtained by pyrolyzing a high molecular-weight alkylene polymer; synthetic hydrocarbon waxes obtained from distillation residues of hydrocarbons obtained from a synthetic gas containing carbon monoxide and hydrogen by the Arge method, and synthetic hydrocarbon waxes obtained by hydrogenating the foregoing synthetic hydrocarbon waxes; and compounds obtained by fractionating these aliphatic hydrocarbon waxes by utilizing press perspiration, the solvent method, vacuum distillation or fractional crystallization.

Hydrocarbons as a base of the above-mentioned aliphatic hydrocarbon waxes include, for example, hydrocarbon compounds (for example, ones synthesized by the synthol method and hydrocoal method (using a fluidized catalyst bed)) synthesized by the reaction of carbon monoxide and hydrogen using a metal oxide catalyst (in many cases, binary or multi-component catalyst); hydrocarbons having up to several hundred carbon atoms obtained by the Arge method (using a fixed catalyst bed), which can provide much waxy hydrocarbon; and hydrocarbons obtained by polymerization of alkylenes such as ethylene by the Ziegler catalyst. In the present invention, among these hydrocarbons, those having fewer and smaller branches and longer saturated straight chains are preferable, and those synthesized otherwise than polymerization of alkylenes are especially preferable in view of the molecular weight distribution.

Specific examples available include Viscol® 330-P, 550-P, 660-P, TS-200 (Sanyo Chemical Industries, Ltd.), HI-WAX 400P, 200P, 100P, 410P, 420P, 320P, 220P, 210P, 110P (Mitsui Chemicals, Inc.), Sasol H1, H2, C80, C105, C77 (Schuman-Sasol Co.), HNP-1, HNP-3, HNP-9, HNP-10, HNP-11, HNP-12 (Nippon Seiro Co., Ltd.), Unilin® 350, 425, 550, 700, Unisid® 350, 425, 550, 700 (Toyo Petrolite Co.), and Japan wax, beeswax, rice wax, candelilla wax, and carnauba wax (available at Cerarica NODA Co., Ltd.).

The releasing agent may be added on melting/kneading in the toner preparation or in a binder resin preparation, and is suitably selected from existing methods. The releasing agent may be used singly or in a combination thereof.

Preferably not less than 1 part by mass and not more than 20 parts by mass of the releasing agent is added to 100 parts by mass of a binder resin. The addition of less than 1 part by mass cannot provide a desired sufficient releasing effect; and the addition exceeding 20 parts by mass causes poor dispersion in a toner, adhesion of a toner to a photosensitive member, and surface contamination of developing members and cleaning members, easily causing problems such as deterioration of toner images.

When a toner is used as a nonmagnetic toner, pigments or dyes described below can be used as a colorant.

As a colorant, carbon blacks, one or more of other conventionally pigments or dyes can be used.

Dyes include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6. Pigments include chrome yellow, cadmium yellow, mineral fast yellow, Naple yellow, naphthol yellow S, Hanza yellow G, permanent yellow NCG, tartrazine lake, chrome orange, molybdenum orange, permanent orange GTR, pyrazolone orange, benzidine orange G, cadmium red, permanent red 4R, watching red calcium salt, eosine lake, brilliant carmine 3B, manganese violet, fast violet B, Methylviolet Lake, iron blue, cobalt blue, AlkaliBlue Lake, Victoria Blue Lake, phthalocyanine blue, fast sky blue, indathrene blue BC, chrome green, chrome oxide, Pigment Green B, malachite green lake and final yellow green G.

When the toner of the present invention is used as a toner forming full-color images, there are the following colorants. Coloring pigments for magenta include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. Pigment Violet 19, C.I. Vat Red 1, 2, 10, 13, 15, 23, 29 and 35.

Although the magenta pigment may be used singly, improving the color definition by using a dye together with the pigment is more preferable in view of the image quality of full-color images. Dyes for magenta include oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27 and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, 40, C.I. Basic Violet 1, 3, 7, 10, 14, 15, 21, 25, 26, 27 and 28.

Coloring pigments for cyan include C.I. Pigment Blue 2, 3, 15, 16, 17, C.I. Vat Blue 6, C.I. Acid Blue 45 and copper phthalocyanine pigments obtained by substituting one to five phthalimidomethyl groups on a phthalocyanine skeleton having the following structure.

(Formula 2)

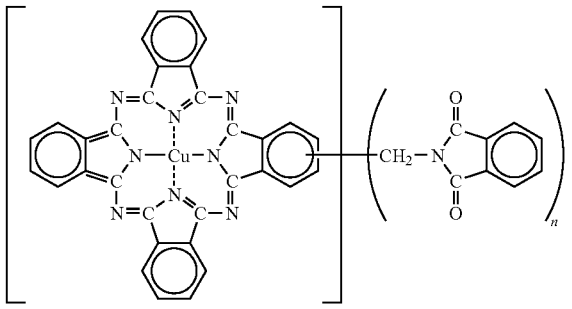

n = 1~5

Coloring pigments for yellow include C.I. Pigment Yellow 1, 2, 3, 4, 5, 6, 7, 10, 11, 12, 13, 14, 15, 16, 17, 23, 35, 73, 83, C.I. Vat Yellow 1, 3 and 20.

A coloring agent is preferably not less than 0.1 parts by mass and not more than 60 parts by mass, more preferably not less than 0.5 parts by mass and not more than 50 parts by mass, based on 100 parts by mass of a resin component.

The toner of the present invention can use a charge controlling agent to stabilize the chargeability. Although a charge controlling agent depends on its kind, properties of other materials constituting toner particles and the like, the charge controlling agent is generally preferably included in an amount of not less than 0.1 parts by mass and not more than 10 parts by mass, further preferably not less than 0.1 parts by mass and not more than 5 parts by mass in toner particles, based on 100 parts by mass of a binder resin. Such charge controlling agents are known to include those which controls a toner for negative charging thereof and those which controls a toner for positive charging thereof and one or more of various charge controlling agents may be used depending on the type and application of the toner.

As charge controlling agents which control toners for negative charging thereof, for example, organic metal complexes and chelate compounds are effective. Their examples include monoazo metal complexes, acetylacetone metal complexes, and metal complexes or metal salts of an aromatic hydroxycarboxylic acid or an aromatic dicarboxylic acid. As charge controlling agents which control toners for negative charging thereof, other examples include aromatic mono- and polycarboxylic acids, their metal salts and their anhydrides; and phenol derivatives of esters and bisphenols. Among these, especially metal complexes or metal salts of an aromatic hydroxycarboxylic acid, which can provide a stable charging capability, are preferably used.

In the present invention, since negatively chargeable toner particles are favorably used, negatively chargeable controlling agents or negatively chargeable controlling resins are preferably used.

Charge controlling agents which control toners for positive charging thereof include, for example, modified compounds by nigrosine, fatty acid metal salts and the like; quaternary ammonium salts such as tributylbenzylammonium 1-hydroxy-4-naphtholsulfonate and tetrabutylammonium tetrafluoroborate, and onium salts of phosphoniums and the like, which are analogs thereof, and their lake pigments; triphenylmethane dyes and their lake pigments (laking agents include phosphotungstic acid, phosphomolybdenic acid, phosphotungstomolybdenic acid, tannic acid, lauric acid, gallic acid, ferricyanic acid and ferrocyanides); metal salts of higher aliphatic acids; diorganotin oxides such as dibutyltin oxide, dioctyltin oxide and dicyclohexyltin oxide; and diorganotin borates such as dibutyltin borate, dioctyltin borate and dicyclohexyltin borate. In the present invention, these may be used singly or in a combination of two or more. As charge controlling agents which control toners for positive charging thereof, among these, charge controlling agents such as nigrosine compounds and quaternary ammonium salts are especially preferably used.

Specific examples available include Spilon Black TRH, T-77, T-95 (Hodogaya Chemical Co., Ltd.), BONTRON® S-34, S-44, S-54, E-84, E-88, E-89 (Orient Chemical Industries, Ltd.), and preferable ones for positive charging are exemplified by TP-302, TP-415 (Hodagaya Chemical Co., Ltd.), BONTRON® N-01, N-04, N-07, P-51 (Orient Chemical Industries, Ltd.), and Copy Blue PR (Clariant International Ltd.).

Charge controlling resins also can be used and can be used together with the charge controlling agents described above.

To the toner of the present invention, as required, other external additives may be added. External additives include, for example, fine resin particles and fine inorganic particles functioning as a charging auxiliary agent, conduction imparting agent, fluidity imparting agent, caking inhibitor, releasing agent at the fixing time by a hot roller, lubricant, abrasive and the like.

Lubricants include, for example, polyethylene fluoride powder, zinc stearate powder and polyvinylidene fluoride powder. Among them, polyvinylidene fluoride powder is preferable. Abrasives include cerium oxide powder, silicon carbide powder and strontium titanate powder. These external additives are fully mixed by a mixer such as a Henschel mixer to obtain the toner of the present invention.

For preparing the toner of the present invention, a binder resin, a colorant and other external additives are fully mixed by a mixer such as a Henschel mixer or a ball mill, then melted and kneaded using a thermal kneader such as a hot roll, kneader or extruder, crushed and classified after cooled and solidified, and further optionally, fully mixed with desired additives by a mixer such as a Henschel mixer to obtain the toner of the present invention.

Mixers include, for example, Henschel mixer (Mitui Mining Co., Ltd.), Super Mixer (Kawata Mfg. Co., Ltd.), Ribocone (Okawara Corp.), Nauter mixer, Turbulizer, Cyclomix (Hosokawa Micron Corp.), Spiral Pin Mixer (Pacific Machinery & Engineering Co., Ltd.) and Loedige mixer (Matsubo Corp.); kneaders include KCR kneader (Kurimoto, Ltd.), Buss co-kneader (Buss AG), TEM extruder (Toshiba Machine Co., Ltd.), TEX twin-screw kneader (Japan Steel Works, Ltd.), PCM kneader (Ikegai Corp.), three-roll mill, mixing roll mill, kneader (Inoue Mfg., Inc.), Kneadex (Mitui Mining Co., Ltd.), MS type compression kneader, Kneader-Ruder (Moriyama Co., Ltd.) and Banbury mixer (Kobe Steel, Ltd.); crushers include Counter Jet Mill, Micron Jet, Inomizer (Hosokawa Micron Corp.), IDS mill, PJM jet crusher (Nippon Pneumatic Mfg. Co., Ltd.), Cross Jet Mill (Kurimoto, Ltd.), Ulmax (Nisso Engineering Co., Ltd.), SK Jet-O-Mill (Seishin Enterprise Co., Ltd.), Kriptron (Kawasaki Heavy Industries, Ltd.), Turbo Mill (Turbo Kogyo Co., Ltd.) and Super Rotor (Nisshin Engineering Inc.); classifiers include Classiel, Micron Classifier, Spedic Classifier (Seishin Enterprise Co., Ltd.), Turbo Classifier (Nisshin Engineering Inc.), Micron Separator, Turboplex (ATP), TSP separator (Hosokawa Micron Corp.), Elbow Jet (Nittetsu Mining Co., Ltd.), dispersion separator (Nippon Pneumatic Mfg. Co., Ltd.) and YM Microcut (Yasukawa Shoji, Ltd.); and sifters for sieving coarse particles or the like include Ultra Sonic (Koei Sangyo Co., Ltd.), Resonasieve, gyrosifter, (Tokuju Corp.), Vibrasonic system (Dalton Inc.), Soniclean (Sintokogyo, Ltd.), Turbo Screener (Turbo Kogyo Co., Ltd.), Microsifter (Makino Mfg. Co., Ltd.) and circular vibration sieves.

The physical properties of the toner of the present invention are measured as follows. Examples described later are also based on the methods.

(1) Measurement of the Particle Diameter of a Toner

Although the particle diameter distribution can be measured by various methods, in the present invention, it is measured using a Multisizer of Coulter Counter.

A Multisizer IIE type of Coulter Counter (Beckman Coulter, Inc.) is used as a measuring apparatus, and is connected to an interface (Nikkaki-bios Co., Ltd.) and an analytical computer to output the number distribution and the volume distribution; and a 1% NaCl aqueous solution is prepared using the special or first grade sodium chloride as an electrolytic solution. The measuring method involves adding 0.1 to 5 ml of a surfactant (preferably alkylbenzenesulfonate) as a dispersant to 100 to 150 ml of the electrolytic aqueous solution, and further adding 2 to 20 mg of a measurement sample thereto. The electrolytic solution in which the sample is suspended is dispersed for approximately 1 to 3 min by an ultrasound disperser and the toner particle diameter is measured by the Coulter Counter Multisizer II using an aperture of 100 μm. The volume and the number of the toner are measured to calculate the volume distribution and the number distribution. Then, the weight-average particle diameter (D4) based on weight is determined from the volume distribution.

(2) Measurement of the Acid Value

In the present invention, the acid value can be measured by the following method.

The basic operation is according to JIS K-0070.

1) 0.5 to 2.0 (g) of a toner is precisely weighed and the weight of the toner is denoted as W (g).

2) The sample is charged in a 300-ml beaker, and added and dissolved with 150 (ml) of a mixed solution of toluene/ethanol (4/1).

3) The resultant solution is titrated using a solution of 0.1 N KOH in methanol and using a potentiometric titrator (for example, the automatic titration using a potentiometric titrator made by Kyoto Electronics Mfg. Co., Ltd., AT-400 (win workstation), and an ABP-410 electric burette can be utilized.).

4) The consumed amount of the KOH solution in the titration is denoted as S (ml) and the consumed amount of the KOH solution simultaneously measured as a blank is denoted as B (ml).

5) The acid value is calculated by the following expression where f is a factor of the KOH.

$$\text{Acid value (mgKOH/g)}=((S-B)\times f\times 5.61)/W$$

(3) Measurement of the softening point of a binder resin

The softening point of a binder resin is measured by a Koka type flow tester according to JIS K 7210. The specific procedure is described below.

By using a Koka type flow tester (Shimadzu Corp.), a sample of 1 $cm^3$, while it is being heated up at a temperature-rising rate of 6° C./min, is loaded with a load of 1,960 $N/m^2$ (20 $kg/cm^2$) by the plunger so as to be extruded out through a nozzle of 1 mm in diameter and 1 mm in length. Thereby, a curve of the plunger descending amount (flow value) vs. the temperature is drawn; when the height of the S-shaped curve is denoted as h, the temperature at h/2 (temperature where a half of the resin has flowed out) is denoted as a softening temperature.

(4) Measurement of the Glass Transition Temperature of a Binder Resin

A measuring apparatus: a differential scanning calorimeter (DSC), MDSC-2920 (manufactured by TA Instruments)

The measurement is conducted according to ASTM D3418-82.

2 to 10 mg, preferably 3 mg of a measurement sample is precisely weighed. The weighed sample is charged in an aluminum pan; and the measurement is conducted at a temperature-rising rate of 10° C./min in the measurement temperature range from 30 to 200° C. in ordinary humidity with use of an empty pan as a reference. The analysis is conducted by using a DSC curve in the range of temperatures from 30 to 200° C. obtained from a temperature-rising process at the second time.

(5) Measurement of the Molecular Weight Distribution by Gel Permeation Chromatography (GPC)

A column is stabilized in a heat chamber at 40° C.; THF as a solvent is made to flow through the column at this temperature at a flow rate of 1 ml/min and approximately 100 μl of a THF sample solution is injected thereto for the measurement. For the molecular weight measurement of a sample, the molecular weight distribution a sample has is calculated from a relation between the logarithmic value and the count value of a calibration curve fabricated using several kinds of monodispersion polystyrene standard samples. As the standard polystyrene samples for the fabrication of a calibration curve, for example, standard polystyrene samples whose molecular weights are approximately $10^2$ to $10^7$ made by Tosoh Corp. or Showa Denko K.K. are used and use of at least about ten kinds of standard polystyrene samples is appropriate. A detector is an RI (refraction index) detector. A combination of some commercially available polystyrene gel columns are preferably used including, for example, Shodex GPC KF-801, 802, 803, 804, 805, 806, 807 and 800P made by Showa Denko K.K., and a combination of TSkgel G1000H ($H_{xL}$), G2000H ($H_{xL}$), G3000H ($H_{xL}$), G4000H ($H_{xL}$), G5000H($H_{xL}$), G6000H($H_{xL}$), G7000H($H_{xL}$) and TSkgurd column made by Tosoh Corp.

Samples are prepared as follows.

A sample is added in THF, allowed to stand at 25° C. for several hours, fully shaken to be fully mixed with THF (until no lumps of the sample are present), and further allowed to stand for at least 12 h. At this time, the standing time in THF is made to be 24 h. Thereafter, the THF solution is passed through a sample treatment filter (pore diameter: 0.2 to 0.5 μm, for example, My Shori-Disk H-25-2 (Tosoh Corp.) is usable.) to make the solution a sample for GPC. The concentration of the sample is adjusted to become 0.5 to 5 mg/ml in terms of resin component.

EXAMPLES

Heretofore, the basic constitutions and features of the present invention have been described, and hereinafter, the present invention will be described specifically by way of examples. However, the embodiments of the present invention are not limited thereto. "Parts" described in Tables 3 and 4 means "parts by mass".

| <Preparation example of a binder resin 1> | |
|---|---|
| Terephthalic acid | 24 mol % |
| Dodecenylsuccinic acid | 16 mol % |
| Trimellitic acid | 7 mol % |
| A bisphenol derivative represented by the formula (I-1) described before (2.5 mol addition of propylene oxide) | 31 mol % |
| A bisphenol derivative represented by the formula (I-1) described before (2.5 mol addition of ethylene oxide) | 22 mol % |

The above acid components and alcohol components both of which are monomers to produce a polyester unit, and tin 2-ethylhexanoate as a catalyst were charged in a four-neck flask; a pressure reducing apparatus, a water separating apparatus, a nitrogen gas introducing apparatus, a temperature measuring apparatus and a stirring apparatus were provided for the flask; and a mixture of 25 parts by mass of monomers shown below to produce a styrene-acrylic resin unit based on 100 parts by mass of the monomer components described above to produce a polyester unit and a polymerization initiator (benzoyl peroxide) was dropwise charged from a dropping funnel spending 4 h while the solution was being stirred in a nitrogen atmosphere at a temperature of 130° C.

Styrene 82 mass %

2-Ethylhexyl acrylate 16 mass %

Acrylic acid 2 mass %

The solution was kept at 130° C. and aged for 3 h, and the temperature was raised to 230° C. for reaction. After the completion of the reaction, the product was taken out from the flask and crushed to obtain a binder resin 1(H) which included a polyester resin component, a vinyl polymer component and a hybrid resin component obtained by chemically bonding a polyester unit and a styrene-acrylic resin unit and which had a softening point of 131° C.

Next,

| | |
|---|---|
| Terephthalic acid | 27 mol % |
| Dodecenylsuccinic acid | 13 mol % |
| Trimellitic acid | 3 mol % |

-continued

| | |
|---|---|
| A bisphenol derivative represented by the formula (I-1) described before (2.5 mol addition of propylene oxide) | 31 mol % |
| A bisphenol derivative represented by the formula (I-1) described before (2.5 mol addition of ethylene oxide) | 26 mol % |

the above acid components and alcohol components as monomers to produce a polyester unit and tin 2-ethylhexanoate as a catalyst were charged in a four-neck flask; a pressure reducing apparatus, a water separating apparatus, a nitrogen gas introducing apparatus, a temperature measuring apparatus and a stirring apparatus were installed to the flask; and a mixture of 25 parts by mass of monomers shown below to produce a styrene-acrylic resin unit based on 100 parts by mass of the monomer components described above to produce a polyester unit and a polymerization initiator (benzoyl peroxide) was dropwise charged from a dropping funnel spending 4 h while the solution was being stirred in a nitrogen atmosphere at a temperature of 130° C.

Styrene 84 mass %

2-Ethylhexyl acrylate 14 mass %

Acrylic acid 2 mass %

The solution was kept at 130° C. and aged for 3 h, and the temperature was raised to 230° C. for reaction. After the completion of the reaction, the product was taken out from the flask and crushed to obtain a binder resin 1(L) which included a polyester resin component, a vinyl polymer component and a hybrid resin component obtained by chemically bonding a polyester unit and a styrene-acrylic resin unit and which had a softening point of 99° C.

60 parts by mass of the binder resin 1 (H) and 40 parts by mass of the binder resin 1(L) were mixed by a Henschel mixer to make a binder resin 1.

The binder resin 1 had a glass transition temperature of 59° C. and a softening point of 128° C. and included 37 mass % of components having a molecular weight of not more than 10,000 in GPC.

| <Preparation example of a binder resin 2> | |
|---|---|
| Terephthalic acid | 31 mol % |
| Dodecenylsuccinic acid | 11 mol % |
| Trimellitic acid | 6 mol % |
| A bisphenol derivative represented by the formula (I-1) described before (2.5 mol addition of propylene oxide) | 35 mol % |
| A bisphenol derivative represented by the formula (I-1) described before (2.5 mol addition of ethylene oxide) | 17 mol % |

The above acid components and alcohol components and an esterification catalyst were charged in a four-neck flask; a pressure reducing apparatus, a water separating apparatus, a nitrogen gas introducing apparatus, a temperature measuring apparatus and a stirring apparatus were installed to the flask; and the reaction was performed in a nitrogen atmosphere by raising the temperature to 230° C. After the completion of the reaction, the product was taken out from the flask, cooled and crushed to obtain a binder resin 2(H) having a softening temperature of 142° C.

Next,

| | |
|---|---|
| Terephthalic acid | 26 mol % |
| Dodecenylsuccinic acid | 11 mol % |

-continued

| | |
|---|---|
| Trimellitic acid | 11 mol % |
| A bisphenol derivative represented by the formula (I-1) described before (2.5 mol addition of propylene oxide) | 30 mol % |
| A bisphenol derivative represented by the formula (I-1) described before (2.5 mol addition of ethylene oxide) | 22 mol % |

the above acid components and alcohol components and an esterification catalyst were charged in a four-neck flask; a pressure reducing apparatus, a water separating apparatus, a nitrogen gas introducing apparatus, a temperature measuring apparatus and a stirring apparatus were installed to the flask; and the reaction was performed in a nitrogen atmosphere by raising the temperature to 230° C. After the completion of the reaction, the product was taken out from the flask, cooled and crushed to obtain a binder resin 2(L) having a softening temperature of 97° C.

70 parts by mass of the binder resin 2(H) and 30 parts by mass of the binder resin 2(L) were mixed by a Henschel mixer to make a binder resin 2.

The binder resin 2 had a glass transition temperature of 56° C. and a softening point of 134° C. and included 36 mass % of components having a molecular weight of not more than 10,000 in GPC.

| <Preparation example of a binder resin 3> | |
|---|---|
| Styrene | 81 parts by mass |
| Butyl acrylate | 19 parts by mass |
| Monobutyl maleate | 0.5 parts by mass |
| Di-tert-butyl peroxide | 2 parts by mass |

The above monomer composition was mixed in 200 parts by mass of xylene whose temperature was raised to the refluxing temperature. The solution polymerization was completed in 6 h in refluxing of xylene to obtain a low molecular weight resin solution. On the other hand, the following monomer composition was mixed, suspended and dispersed with 200 parts by mass of deaerated water and 0.2 parts by mass of a polyvinyl alcohol.

| | |
|---|---|
| Styrene | 67 parts by mass |
| Butyl acrylate | 27 parts by mass |
| Monobutyl maleate | 6 parts by mass |
| Benzoyl peroxide | 0.1 parts by mass |

The suspended and dispersed solution was heated, kept at 80° C. for 24 h in a nitrogen atmosphere for the completion of polymerization, dewatered, and dried to obtain a high molecular weight resin.

77 parts by mass of the high molecular weight resin was charged in the above-mentioned low molecular weight resin solution (containing 23 parts by mass of the resin fraction), completely dissolved and mixed in the solution, and thereafter, distilled under vacuum at a high temperature (180° C.) for removing the solvent to obtain a binder resin 3.

The binder resin 3 had a glass transition temperature of 60° C. and a softening point of 128° C. and included 38 mass % of components having a molecular weight of not more than 10,000 in GPC.

<Preparation Example of a Fine Silica Powder B-1>

A mixed gas of argon and oxygen having a volume ratio of 3:1 was introduced in a reaction vessel to replace the air. An oxygen gas and a hydrogen gas were supplied to the reaction vessel at 40 ($m^3$/h) and 20 ($m^3$/h), respectively, to form a combustion flame composed of oxygen-hydrogen using an ignition apparatus. Then, a metal silicon powder of a raw material was charged in the combustion flame by a hydrogen carrier gas of 5 kg/$cm^3$ in pressure to form powder dust clouds. The powder dust clouds were ignited by the combustion flame to cause oxidation reaction by dust explosion. After the oxidation reaction, the reaction vessel was cooled at a rate of 3° C./min and a fine silica powder B-1 was obtained.

<Preparation Example of a Fine Silica Powder B-2>

A fine silica powder B-2 was obtained as in the preparation example B-1, except for the pressure of the carrier gas set at 12 kg/$cm^3$.

<Preparation Example of a Fine Silica Powder B-3>

A fine silica powder B-3 was obtained as in the preparation example B-1, except for the pressure of the carrier gas set at 8 kg/$cm^3$.

<Preparation Example of a Fine Silica Powder B-4>

A mixed gas of argon and oxygen having a volume ratio of 3:1 was introduced in a reaction vessel to replace the air. An oxygen gas and a hydrogen gas were supplied to the reaction vessel at 40 ($m^3$/h) and 20 ($m^3$/h), respectively, to form a combustion flame composed of oxygen-hydrogen using an ignition apparatus. Then, a hexamethyldisiloxane powder of a raw material was charged in the combustion flame by a hydrogen carrier gas of 5 kg/$cm^3$ in pressure to form powder dust clouds. The powder dust clouds were ignited by the combustion flame to cause oxidation reaction by dust explosion. After the oxidation reaction, the reaction vessel was cooled at a rate of 3° C./min and a fine silica powder B-4 was obtained.

<Preparation Example of a Fine Silica Powder B-5>

A fine silica powder B-5 was obtained as in the preparation example B-1, except for the pressure of the carrier gas set at 3 kg/$cm^3$ and the cooling rate at 5° C./min.

<Preparation Example of a Fine Silica Powder B-6>

A fine silica powder B-6 was obtained as in the preparation example B-1, except for the pressure of the carrier gas set at 1 kg/$cm^3$ and the cooling rate at 10° C./min.

<Preparation Example of a Fine Silica Powder B-7>

A fine silica powder B-7 was obtained as in the preparation example B-4, except for the pressure of the carrier gas set at 1 kg/$cm^3$ and the cooling rate at 20° C./min.

<Preparation Example of a Fine Silica Powder B-8>

14 L of ethanol and 1.5 kg of a 28% ammonia aqueous solution were added in a 30 L reaction vessel made of glass equipped with a stirrer, a dripping inlet and a thermometer; then, 0.26 kg of an ammonia gas was further blown in to absorb it and mixed therein to prepare an ammonia-mixed solution. While the mixed solution was adjusted at 10° C.±0.5° C. and stirred, a mixed solution of 1,130 g of tetraethoxysilane as a silane compound and 63 g of 3-aminopropyltriethoxysilane as a silane compound was dropwise charged for hydrolysis while the temperature inside the reaction vessel was kept at 20° C., and a suspension of fine silica particles was obtained. The fine silica particles were further baked at 250° C. to obtain a fine silica powder B-8.

<Preparation Example of a Fine Silica Powder B-9>

2.18 L of water, 7 L of methanol and 1.0 kg of a 28% ammonia aqueous solution were added in a 30 L reaction vessel made of glass equipped with a stirrer, a dripping mouth and a thermometer to prepare an ammonia-mixed solution. While the mixed solution was adjusted at 40° C.±0.5° C. and stirred, a mixed solution of 912 g of tetramethoxysilane as a silane compound and 1.2 L of methanol was dropwise charged for hydrolysis while the temperature inside the reaction vessel was kept at 40° C., and a suspension of fine silica particles was obtained. The fine silica particles were further baked at 250° C. to obtain a fine silica powder B-9.

<Preparation Example of a Fine Silica Powder B-10>

A fine silica powder B-10 was obtained as in the preparation example B-1, except for the pressure of the carrier gas set at 16 kg/$cm^3$.

Physical properties of the above-mentioned fine silica powders (B-1) to (B-10) are shown in Table 1.

Example 1

| | |
|---|---|
| The binder resin 1 | 100 parts by mass |
| Magnetic iron oxide particles (average particle diameter: 0.15 μm; coercive force (Hc) at 796 kA/m: 11.5 kA/m; saturation magnetization (σs): 90 $Am^2/kg$; and residual magnetization (σr): 16 $Am^2/kg$) | 60 parts by mass |
| A wax b (Fischer-Tropsch wax; melting point: 105° C.) | 4 parts by mass |
| A charge controlling agent c | 2 parts by mass |

The above materials were premixed by a Henschel mixer, and then melted and kneaded by a twin-screw extruder. At this time, the staying time was controlled such that the temperature of the kneaded resin became 150° C.

The obtained kneaded material was cooled, coarsely crushed by a hammer mill, and pulverized by a turbo mill; and the obtained finely pulverized powder was classified using a multi-division classifier utilizing the Coanda effect to obtain toner particles having a weight average particle diameter of 5.8 μm. 1.0 part by mass of a hydrophobic inorganic fine powder "a" (silica; BET: 140 $m^2/g$; and hydrophobized with 30 parts by mass of hexamethyldisilazane (HMDS) and 10 parts by mass of a dimethylsilicone oil), 0.2 parts by mass of the fine silica powder B-1 and 3.0 parts by mass of strontium titanate were externally added and mixed into 100 parts by mass of the toner particles, and sieved through a mesh of 150 μm in aperture to obtain a toner 1.

Toner internal addition formulations are shown in Table 4 and physical properties are shown in Table 5.

For evaluating the toner 1 under conditions of higher speed and higher resolution, a remodeled machine of a commercially available copying machine (IR-6570, Canon Corp.) which was remodeled into 2,400 dpi and 1.5-fold printing-speed was used. 500,000 sheets were continuously printed using a test chart of 5% in printing proportion under each environment of a high-temperature high-humidity environment (30° C., 80% RH), an ordinary-temperature ordinary-humidity environment (23° C., 50% RH) and an ordinary-temperature low-humidity environment (23° C., 5% RH) to evaluate the following.

(Image Density, Fogging)

The image density was measured as the reflection density of 5 mm-circle images by a Macbeth densitometer (Macbeth Co.) using an SPI filter. To determine fogging, a reflection densitometer (reflectometer, model: TC-6DS, Tokyo Denshoku Co., Ltd.); was used, and the fogging level was given by Ds−Dr to evaluate fogging where Ds denotes the worst reflection density for white background after image formation and Dr denotes the average reflection density for the transfer material before image formation. Therefore, the smaller value of the fogging amount indicates the better fogging suppression. This evaluation was conducted at the initial printing time and 500,000-sheets printing time in the each test environment. The evaluation results are shown in Tables 6, 7 and 8.

(Line Width Reproducibility)

The reproducibility of the line width was evaluated at the initial printing time and after the 500,000-sheets continuous printing in the each test environment using the above-mentioned image forming testing machine by the following method. Latent images (horizontal lines) of 168 μm in line width were obtained using a laser of 2,400 dpi. The line widths after image formation of the latent images were magnified at ×150 magnification by an optical microscope and the images were measured using an image analyzing soft (Image Pro) to determine the change rate to the line widths of the latent images using the expression below from the average value of three lines; and the reproducibility of the line width was evaluated on the following standard. The results are shown in Tables 6, 7 and 8.

line width change rate (%)=(|line width of latent image−line width of formed image|)/(line width of latent image)×100 (Expression 1)

A: change rate of not more than 5%

B: change rate exceeding 5% and not more than 10%

C: change rate of exceeding 10% and not more than 20%

D: change rate exceeding 20%

(Evaluation of Tailing)

The tailing was evaluated at the initial printing time and after the 500,000-sheets printing formation in the each test environment by forming three horizontal line images at intervals of 1 cm under the condition of making the line width on sheets at 168 μm using the above-mentioned image forming test machine. The images were magnified at ×150 magnification by an optical microscope and the line widths of the magnified images were measured at intervals of 3 μm to determine the standard deviations of the line widths. The average standard deviation of three lines was determined from the standard deviation of each line. The level of tailing was evaluated on the following standard. The results are shown in Tables 6, 7 and 8.

A: standard deviation of not more than 5

B: standard deviation exceeding 5 and not more than 15

C: standard deviation exceeding 15 and not more than 25

D: standard deviation exceeding 25

(Evaluation of the Dot Reproducibility)

The dot reproducibility was evaluated at the initial printing time and after the 500,000-sheets printing formation in the each test environment by forming images of an isolated one-dot pattern of 2,400 dpi using the above-mentioned image forming test machine. The images were observed by an optical microscope to examine the dot reproducibility, which was evaluated on the following standard. The results are shown in Tables 6, 7 and 8.

A: No spread of toner out of latent images was observed and dots were completely reproduced.

B: Slight spread of toner out of latent images was observed.

C: spread of toner out of latent images was observed.

D: Notable spread of toner out of latent images was observed.

Examples 2 to 5

Toners 2 to 5 were obtained as in Example 1, but with the formulations described in Table 4 (hydrophobic fine inorganic powders are described in Table 3; fine silica powders in Table 1; and waxes in Table 2). Physical properties of the toners thus obtained are shown in Table 5. The results of tests similar to Example 1 are shown in Tables 6, 7 and 8.

Example 6

A toner 6 was obtained as in Example 1, but with the formulation described in Table 4 (a hydrophobic fine inorganic powder is described in Table 3; a fine silica powder in Table 1; and a wax in Table 2) and with the rotation frequency of the turbo mill raised by 10%. Physical properties of the toner thus obtained are shown in Table 5. The results of tests similar to Example 1 are shown in Tables 6, 7 and 8.

Example 7

A toner 7 was obtained as in Example 1, but with the formulation described in Table 4 (a hydrophobic fine inorganic powder is described in Table 3; a fine silica powder in Table 1; and a wax in Table 2) and with the rotation frequency of the turbo mill reduced by 20%. Physical properties of the toner thus obtained are shown in Table 5. The results of tests similar to Example 1 are shown in Tables 6, 7 and 8.

Examples 8 and 9

Toners 8 and 9 were obtained as in Example 1, but with the formulations described in Table 4 (hydrophobic fine inorganic powders are described in Table 3; fine silica powders in Table 1; and waxes in Table 2) and with the rotation frequency of the turbo mill reduced by 10%. Physical properties of the toners thus obtained are shown in Table 5. The results of tests similar to Example 1 are shown in Tables 6, 7 and 8.

Comparative Example 1

A toner 10 was obtained as in Example 1, but with the formulation described in Table 4 (a hydrophobic fine inorganic powder is described in Table 3; and a wax in Table 2) and without addition of a fine silica powder. Physical properties of the toner thus obtained are shown in Table 5. The results of tests similar to Example 1 are shown in Tables 6, 7 and 8.

Comparative Examples 2 to 5

Toners 11 to 14 were obtained as in Example 1, but with the formulations described in Table 4 (hydrophobic fine inorganic powders are described in Table 3; fine silica powders in Table 1; and waxes in Table 2). Physical properties of the toners thus obtained are shown in Table 5. The results of tests similar to Example 1 are shown in Tables 6, 7 and 8. Herein, in Comparative Example 5, alumina (TM10, TAIMEI Chemicals Co., Ltd.) was used instead of a fine silica powder.

TABLE 1

Fine silica powder

| Fine silica powder | D50 (μm) | Total pore volume (cm3/g) | Average pore diameter (nm) | Moisture adsorption (mass %) at a relative humidity of 80% RH | BET (m2/g) |
|---|---|---|---|---|---|
| B-1 | 1.21 | 0.016 | 13.9 | 0.07 | 4.7 |
| B-2 | 0.78 | 0.017 | 12.7 | 0.10 | 5.8 |
| B-3 | 1.01 | 0.016 | 13.4 | 0.06 | 5.2 |
| B-4 | 1.47 | 0.015 | 14.7 | 0.05 | 4.1 |
| B-5 | 1.88 | 0.068 | 28.2 | 0.29 | 3.2 |
| B-6 | 2.52 | 0.112 | 42.5 | 0.41 | 2.1 |
| B-7 | 2.98 | 0.195 | 52.3 | 1.41 | 1.2 |
| B-8 | 1.41 | 0.321 | 52.5 | 7.61 | 2.9 |
| B-9 | 0.10 | 0.397 | 54.3 | 8.06 | 29.2 |
| B-10 | 0.50 | 0.024 | 11.1 | 0.19 | 8.5 |

TABLE 2

Wax

| | Kind | Maximum endothermic peak temperature (° C.) | Number-average molecular weight | Weight-average molecular weight |
|---|---|---|---|---|
| Wax a | Paraffin wax | 75 | 800 | 1100 |
| Wax b | Fischer-Tropsch wax | 105 | 1500 | 2500 |

TABLE 3

Hydrophobic fine inorganic powder

| | Hydrophobic fine inorganic powder | BET (m2/g) | Hydrophobizing agent HMDS (parts) | Hydrophobizing agent Dimethylsilicone oil (parts) |
|---|---|---|---|---|
| A | Silica | 140 | 30 | 10 |
| B | Silica | 135 | 25 | 10 |
| C | Silica | 245 | 20 | — |
| D | Silica | 350 | 33 | — |
| E | Alumina | 40 | 24 | 10 |

TABLE 4

Toner formulation

| | Toner No. | Binder resin | Wax | Wax loading (parts) | Charge controlling agent | Charge controlling agent loading (parts) | Hydrophobic fine inorganic powder | Loading (parts) | Fine silica powder | Loading (parts) |
|---|---|---|---|---|---|---|---|---|---|---|
| Example 1 | 1 | A-1 | b | 4 | c | 2 | a | 1.0 | B-1 | 0.2 |
| Example 2 | 2 | A-1 | b | 4 | c | 2 | b | 0.8 | B-2 | 0.2 |
| Example 3 | 3 | A-2 | b | 4 | b | 2 | a | 1.0 | B-3 | 0.4 |
| Example 4 | 4 | A-1 | a | 2 | b | 2 | c | 1.2 | B-4 | 0.1 |
| Example 5 | 5 | A-2 | a | 2 | c | 2 | b | 1.5 | B-5 | 0.5 |
| Example 6 | 6 | A-2 | b | 4 | a | 2 | a | 0.8 | B-2 | 0.1 |
| Example 7 | 7 | A-2 | b | 4 | c | 2 | a | 1.0 | B-2 | 0.1 |
| Example 8 | 8 | A-3 | a/b | 4/2 | b | 2 | d | 1.0 | B-6 | 0.05 |
| Example 9 | 9 | A-3 | a | 3 | b | 2 | e | 0.8 | B-7 | 0.2 |
| Comparative Example 1 | 10 | A-1 | b | 4 | a | 2 | a | 1.0 | — | — |
| Comparative Example 2 | 11 | A-2 | a | 3 | b | 2 | b | 1.5 | B-8 | 0.2 |

TABLE 4-continued

| | Toner formulation | | | | | | | | | |
|---|---|---|---|---|---|---|---|---|---|---|
| | Toner No. | Binder resin | Wax | Wax loading (parts) | Charge controlling agent | Charge controlling agent loading (parts) | Hydrophobic fine inorganic powder | Loading (parts) | Fine silica powder | Loading (parts) |
| Comparative Example 3 | 12 | A-3 | b | 4 | b | 2 | c | 1.2 | B-9 | 1.0 |
| Comparative Example 4 | 13 | A-3 | a | 4 | c | 2 | a | 0.18 | B-10 | 0.03 |
| Comparative Example 5 | 14 | A-2 | a/b | 3/2 | b | 2 | d | 0.5 | TM10 | 0.1 |

(Formula 3)

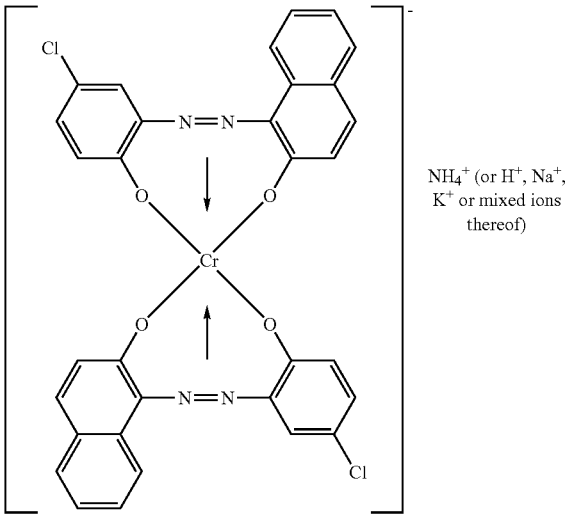

charge controlling agent a

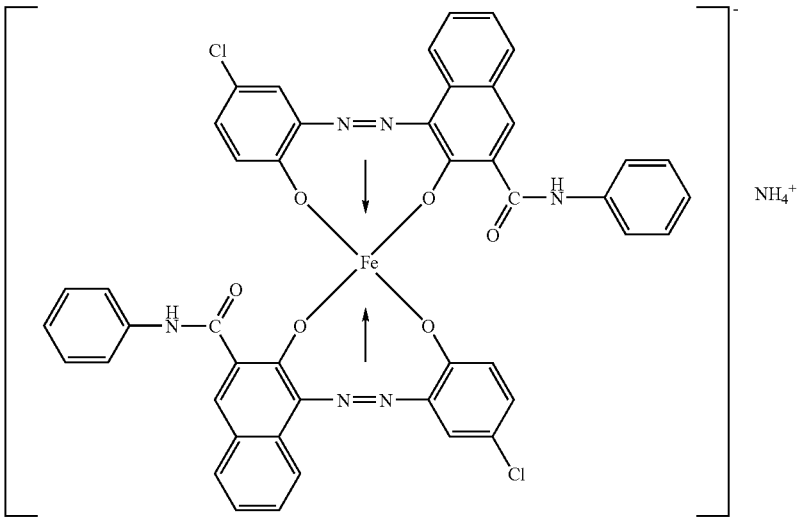

charge controlling agent b

-continued

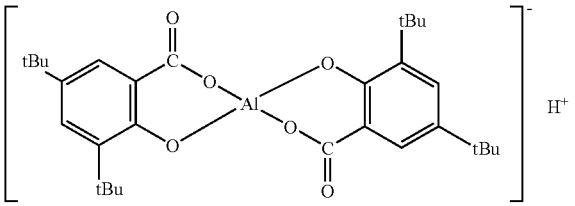

charge controlling agent c

TABLE 5

| | Physical properties of toner | | | | |
|---|---|---|---|---|---|
| | | Toner | Weight-average | Unconfined yield stress of toner (kPa) | |
| | Toner No. | acid value (mgKOH/g) | diameter of toner particles D4(μm) | Maximum consolidation stress 0.1 kPa | Maximum consolidation stress 20.0 kPa |
| Example 1 | 1 | 28.5 | 5.8 | 0.1 | 2.2 |
| Example 2 | 2 | 28.5 | 5.9 | 0.2 | 2.3 |
| Example 3 | 3 | 31.5 | 6.2 | 0.2 | 2.2 |
| Example 4 | 4 | 21.2 | 5.5 | 0.4 | 2.5 |
| Example 5 | 5 | 25.2 | 6.5 | 0.5 | 3.1 |
| Example 6 | 6 | 30.2 | 5.1 | 0.4 | 3.2 |
| Example 7 | 7 | 32.5 | 8.7 | 0.7 | 2.8 |
| Example 8 | 8 | 14.6 | 7.3 | 0.5 | 4.6 |
| Example 9 | 9 | 16.5 | 7.4 | 0.7 | 5.3 |
| Comparative Example 1 | 10 | 21.5 | 6.3 | 2.3 | 6.9 |

TABLE 5-continued

| | Physical properties of toner | | | | |
|---|---|---|---|---|---|
| | | Toner | Weight-average | Unconfined yield stress of toner (kPa) | |
| | Toner No. | acid value (mgKOH/g) | diameter of toner particles D4(μm) | Maximum consolidation stress 0.1 kPa | Maximum consolidation stress 20.0 kPa |
| Comparative Example 2 | 11 | 27.4 | 8.9 | 1.3 | 6.4 |
| Comparative Example 3 | 12 | 10.6 | 7.6 | 1.7 | 5.6 |
| Comparative Example 4 | 13 | 12.2 | 10.0 | 1.4 | 6.2 |
| Comparative Example 5 | 14 | 14.5 | 9.2 | 2.1 | 6.8 |

TABLE 6

| | Evaluation results at high-temperature and high-humidity environment (30° C./80% RH) | | | | | | | | | |
|---|---|---|---|---|---|---|---|---|---|---|
| | Image density | | Fogging | | Line width reproducibility | | Tailing | | Dot reproducibility | |
| | At initial printing | After 500,000-sheets printing | At initial printing | After 500,000-sheets printing | At initial printing | After 500,000-sheets printing | At initial printing | After 500,000-sheets printing | At initial printing | After 500,000-sheets printing |
| Example 1 | 1.43 | 1.42 | 0.56 | 0.60 | A | A | A | A | A | A |
| Example 2 | 1.41 | 1.41 | 0.58 | 0.65 | A | A | A | B | A | B |
| Example 3 | 1.42 | 1.41 | 0.62 | 0.71 | A | A | A | B | A | B |
| Example 4 | 1.42 | 1.42 | 0.47 | 0.61 | A | A | A | B | A | B |
| Example 5 | 1.40 | 1.39 | 1.16 | 1.25 | A | B | B | B | B | B |
| Example 6 | 1.40 | 1.38 | 0.57 | 0.66 | A | A | A | B | A | B |
| Example 7 | 1.41 | 1.40 | 0.56 | 0.62 | A | B | A | B | B | B |
| Example 8 | 1.41 | 1.39 | 1.08 | 1.21 | B | B | B | C | B | B |
| Example 9 | 1.39 | 1.36 | 1.74 | 1.82 | B | C | C | C | B | C |
| Comparative Example 1 | 1.33 | 1.31 | 2.51 | 2.62 | D | D | D | D | D | D |
| Comparative Example 2 | 1.35 | 1.30 | 2.62 | 2.70 | C | D | C | D | D | D |
| Comparative Example 3 | 1.31 | 1.29 | 2.84 | 2.85 | D | D | C | D | C | D |
| Comparative Example 4 | 1.31 | 1.30 | 2.32 | 2.51 | C | C | C | D | D | D |
| Comparative Example 5 | 1.32 | 1.30 | 2.45 | 2.62 | D | D | D | D | D | D |

TABLE 7

Evaluation results at ordinary-temperature and ordinary-humidity environment (23° C./50% RH)

| | Image density | | Fogging | | Line width reproducibility | | Tailing | | Dot reproducibility | |
|---|---|---|---|---|---|---|---|---|---|---|
| | At initial printing | After 500,000-sheets printing | At initial printing | After 500,000-sheets printing | At initial printing | After 500,000-sheets printing | At initial printing | After 500,000-sheets printing | At initial printing | After 500,000-sheets printing |
| Example 1 | 1.44 | 1.44 | 0.50 | 0.61 | A | A | A | A | A | A |
| Example 2 | 1.43 | 1.42 | 0.46 | 0.62 | A | A | A | A | A | B |
| Example 3 | 1.44 | 1.43 | 0.51 | 0.69 | A | A | A | B | A | A |
| Example 4 | 1.44 | 1.42 | 0.45 | 0.58 | A | A | A | B | A | A |
| Example 5 | 1.42 | 1.40 | 0.85 | 0.90 | A | B | A | B | A | B |
| Example 6 | 1.42 | 1.40 | 0.45 | 0.61 | A | A | A | A | A | B |
| Example 7 | 1.42 | 1.42 | 0.44 | 0.60 | A | B | A | A | A | B |
| Example 8 | 1.43 | 1.41 | 0.84 | 0.91 | A | B | B | B | A | B |
| Example 9 | 1.40 | 1.38 | 1.16 | 1.62 | B | C | B | C | B | C |
| Comparative Example 1 | 1.35 | 1.34 | 2.11 | 2.22 | D | D | D | D | D | D |
| Comparative Example 2 | 1.36 | 1.32 | 2.35 | 2.41 | C | D | C | D | C | D |
| Comparative Example 3 | 1.34 | 1.31 | 2.54 | 2.65 | D | D | C | D | C | D |
| Comparative Example 4 | 1.35 | 1.30 | 2.23 | 2.41 | C | C | C | D | D | D |
| Comparative Example 5 | 1.33 | 1.30 | 2.32 | 2.56 | D | D | D | D | D | D |

TABLE 8

Evaluation results at ordinary-temperature and low-humidity environment (23° C./5% RH)

| | Image density | | Fogging | | Line width reproducibility | | Tailing | | Dot reproducibility | |
|---|---|---|---|---|---|---|---|---|---|---|
| | At initial printing | After 500,000-sheets printing | At initial printing | After 500,000-sheets printing | At initial printing | After 500,000-sheets printing | At initial printing | After 500,000-sheets printing | At initial printing | After 500,000-sheets printing |
| Example 1 | 1.46 | 1.45 | 0.48 | 0.60 | A | A | A | A | A | A |
| Example 2 | 1.45 | 1.45 | 0.45 | 0.58 | A | A | A | A | A | A |
| Example 3 | 1.45 | 1.43 | 0.50 | 0.63 | A | A | A | A | A | A |
| Example 4 | 1.45 | 1.43 | 0.47 | 0.55 | A | A | A | B | A | A |
| Example 5 | 1.43 | 1.41 | 0.75 | 0.74 | A | B | A | A | A | B |
| Example 6 | 1.44 | 1.41 | 0.47 | 0.60 | A | A | A | A | A | A |
| Example 7 | 1.45 | 1.45 | 0.43 | 0.56 | A | A | A | A | A | B |
| Example 8 | 1.44 | 1.42 | 0.74 | 0.88 | A | B | A | B | A | B |
| Example 9 | 1.40 | 1.39 | 1.10 | 1.06 | B | C | B | B | B | C |
| Comparative Example 1 | 1.36 | 1.35 | 2.05 | 2.22 | D | D | D | D | D | D |
| Comparative Example 2 | 1.36 | 1.32 | 2.11 | 2.41 | C | D | C | C | C | D |
| Comparative Example 3 | 1.35 | 1.33 | 2.35 | 2.65 | C | D | C | C | C | D |
| Comparative Example 4 | 1.35 | 1.31 | 2.14 | 2.41 | C | C | C | D | D | D |
| Comparative Example 5 | 1.30 | 1.29 | 2.26 | 2.56 | D | D | C | C | C | D |

The present application claims the priority to Japanese Patent Application No. 2006-159343, filed on Jun. 8, 2006, the subject of which is part of the present application herein by reference.

What is claimed is:

1. A toner, comprising: toner particles comprising at least a binder resin and a colorant, and a fine silica powder, wherein the fine silica powder has a volume median diameter (D50) of 0.70 μm or more and 3.00 μm or less, a total pore volume of 0.200 $cm^3/g$ or less, as measured in the range of the pore diameters 1.7 nm or more and 300.0 nm or less, and a specific surface area of not less than 1.0 $m^2/g$ and not more than 20.0 $m^2/g$.

2. The toner according to claim 1, wherein the fine silica powder has an average pore diameter of 50.0 nm or less.

3. The toner according to claim 1, which further comprises a hydrophobic fine inorganic powder having a BET specific surface area of 50 $m^2/g$ or more and 300 $m^2/g$ or less.

4. The toner according to claim 1, wherein the fine silica powder has an adsorbed moisture amount, in the adsorption process at the relative humidity of 80% RH in the moisture adsorption-desorption isotherm at 30° C. of the fine silica powder, of 0.01 mass % or more and 1.00 mass % or less.

5. The toner according to claim 1, wherein the fine silica powder is manufactured by a vapor-phase method.

6. The toner according to claim 5, wherein the vapor-phase method is a vapor-phase oxidation method.

* * * * *